US012435884B2

(12) United States Patent
Huang

(10) Patent No.: US 12,435,884 B2
(45) Date of Patent: Oct. 7, 2025

(54) INDUCED DRAFT FAN AND AIR CONDITIONING SYSTEM

(71) Applicant: Xiamen Longwuchun Technology Co., Ltd, Xiamen (CN)

(72) Inventor: Jie Huang, Xiamen (CN)

(73) Assignee: Xiamen Longwuchun Technology Co., Ltd, Xiamen (CN)

( * ) Notice: Subject to any disclaimer, the term of this patent is extended or adjusted under 35 U.S.C. 154(b) by 0 days.

(21) Appl. No.: 18/646,187

(22) Filed: Apr. 25, 2024

(65) Prior Publication Data

US 2025/0251150 A1 Aug. 7, 2025

(30) Foreign Application Priority Data

Feb. 6, 2024 (CN) ..... 202420283756.0

(51) Int. Cl.
*F24F 1/0284* (2019.01)
*F04D 25/08* (2006.01)
(Continued)

(52) U.S. Cl.
CPC ..... *F24F 1/0284* (2019.02); *F04D 25/08* (2013.01); *F04D 25/166* (2013.01); *F04D 27/001* (2013.01); *F04D 29/522* (2013.01)

(58) Field of Classification Search
CPC ..... F04D 25/08; F04D 27/001; F04D 29/522; F24F 1/0284; F24F 2110/10; F24F 2110/12
See application file for complete search history.

(56) References Cited

U.S. PATENT DOCUMENTS 3,059,447 A * 10/1962 Brugler ..... F24F 1/0284 416/223 R
6,402,613 B1 * 6/2002 Teagle ..... F24F 1/0071 454/341
(Continued)

FOREIGN PATENT DOCUMENTS

CN 109028348 A 12/2018
CN 209484752 U * 10/2019
(Continued)

OTHER PUBLICATIONS

Coolerguys, AC Power Fan Cord with Preset Thermal Switch, retrieved from www.coolerguys.com/products/ac-power-fan-cord-with-preset-thermal-switch on Feb. 11, 2021 (Year: 2021).*
(Continued)

*Primary Examiner* — Nathaniel E Wiehe
*Assistant Examiner* — Jason G Davis
(74) *Attorney, Agent, or Firm* — Nitin Kaushik

(57) ABSTRACT

The invention provides an induced draft fan and an air conditioning system. The induced draft fan includes a fan main body, a first temperature sensor, and a second temperature sensor. The fan main body includes an adapter connection line extending from the same for supplying power to the fan main body. The first temperature sensor is mounted on the adapter connection line, electrically connected to the control circuit board inside the fan main body and is capable of detecting an indoor temperature at a location remote from the fan main body. The second temperature sensor is disposed inside the fan main body and faces towards an air inlet end of the fan main body.

8 Claims, 6 Drawing Sheets

(51) Int. Cl.

| | |
|---|---|
| ***F04D 25/16*** | (2006.01) |
| ***F04D 27/00*** | (2006.01) |
| ***F04D 29/52*** | (2006.01) |

(56) References Cited

U.S. PATENT DOCUMENTS

| | | | | |
|---|---|---|---|---|
| 7,966,837 | B2 * | 6/2011 | El-Galley | F24F 1/00075 62/177 |
| 2019/0293305 | A1 * | 9/2019 | Henderson | F24F 11/30 |

FOREIGN PATENT DOCUMENTS

| | | | | |
|---|---|---|---|---|
| CN | 219264431 | U | * | 6/2023 |
| CN | 219390064 | U | | 7/2023 |
| CN | 116624990 | A | | 8/2023 |
| JP | 2008164184 | A | * | 7/2008 |

OTHER PUBLICATIONS

Machine translation of CN 209484752 (Year: 2019).*
Machine translation of CN 219264431 (Year: 2023).*
Machine translation of JP 2008164184 (Year: 2008).*

* cited by examiner

INDUCED DRAFT FAN AND AIR CONDITIONING SYSTEM

CROSS-REFERENCE TO RELATED APPLICATIONS

The application claims priority to Chinese patent application No. 2024202837560, filed on Feb. 6, 2024, the entire contents of which are incorporated herein by reference.

TECHNICAL FIELD

The invention relates to the technical field of air conditioning systems and in particular to an induced draft fan and an air conditioning system.

BACKGROUND

The induced draft fan is applied to the air outlet end of the air conditioning system and installed indoors, so that the cold/hot air in the air conditioning pipeline can be drawn out and discharged into the room when the force of the air conditioning fan is insufficient, so as to avoid the accumulation of cold/hot air in the pipeline, which thus causes it difficult to lower/raise the room temperature. At present, the induced draft fan on the market is generally provided with only one temperature sensor, which is installed inside the induced draft fan or the air-conditioning pipeline for detecting the air temperature in the pipeline or in the induced draft fan. It does not measure the indoor temperature, and cannot intelligently or automatically adjust the starting state of the induced draft fan according to the conditions of the indoor temperature and the temperature in the pipeline.

SUMMARY

In order to solve the above-mentioned technical problem, the invention proposes a solution capable of accurately controlling the starting of the induced draft fan.

In a first aspect, the invention provides an induced draft fan including a fan main body, a first temperature sensor, and a second temperature sensor.

The fan main body includes an adapter connection line extending from the same for supplying power to the fan main body.

The first temperature sensor is mounted on the adapter connection line, electrically connected to the control circuit board inside the fan main body and is capable of detecting an indoor temperature at a location remote from the fan main body.

The second temperature sensor is disposed inside the fan main body and faces towards an air inlet end of the fan main body, and is electrically connected to the control circuit board inside the fan main body. It can detect the air temperature inside the fan main body or inside the pipeline.

The invention can acquire a more accurate indoor temperature value by arranging the first temperature sensor on an adapter connection line of a fan main body so as to follow the adapter connection line away from the fan main body, thereby achieving accurate control of the fan main body after comparing the indoor temperature value and the pipeline temperature value. Meanwhile, it can avoid improper start-up or shut-down instructions of the induced draft fan caused by measurement errors of the temperature value.

Preferably, the first temperature sensor is mounted on a connector of the adapter connection line with a sensing probe exposed so as to be as far away from the fan main body as possible.

Preferably, the wires of the first temperature sensor and the adapter connection line share a same wire protection rubber sleeve to prevent the wires of the first temperature sensor from being exposed.

Preferably, the first temperature sensor and the connector of the adapter connection line share a same encapsulated housing, simplifying the structure of the connector and reducing subsequent assembly steps. The structure is compact and firm.

Preferably, a negative ion generator is further disposed inside the fan main body and electrically connected to the control circuit board inside the fan main body, so that negative ions can be supplied to the room to purify air.

Preferably, in order to prevent the negative ion generator from affecting the operation of the control circuit board and its display screen, the negative ion generator is disposed at a position away from the control circuit board, for example, to create a grainy screen.

Preferably, the fan main body comprises a rear cover and a panel; the rear cover is provided with a mounting groove facing towards the panel; the control circuit board is mounted in the mounting groove; the panel covers the rear cover and presses the control circuit board; and the control circuit board is provided with a display screen and keys; and the panel is provided with avoidance openings corresponding to both the display screen and the keys.

Preferably, the fan main body comprises two blowers arranged side by side to provide a greater suction force.

In a second aspect, the invention provides an air conditioning system comprising an air conditioning unit and the induced draft fan of the first aspect.

As apparent from the above description of the invention, the invention has the following advantageous effects.

1. The invention can acquire a more accurate indoor temperature value by arranging the first temperature sensor on an adapter connection line of a fan main body so as to follow the adapter connection line away from the fan main body, thereby achieving accurate control of the fan main body after comparing the indoor temperature value and the pipeline temperature value. Meanwhile, it can avoid improper start-up or shut-down instructions of the induced draft fan caused by measurement errors of the temperature value.

2. The first temperature sensor and the connector of the adapter connection line share a same encapsulated housing, simplifying the structure of the connector and reducing subsequent assembly steps. The structure is compact and firm.

3. By disposing the negative ion generator at a position away from the control circuit board, the negative ion generator can be prevented from affecting the operation of the control circuit board and the display screen thereof.

BRIEF DESCRIPTION OF DRAWINGS

The accompanying drawings, which are included to provide a further understanding of the invention and are incorporated in and constitute a part of the invention, illustrate embodiments of the invention and together with the description serve to explain the invention and are not intended to limit the invention in any way.

In the drawings.

Figure 1:
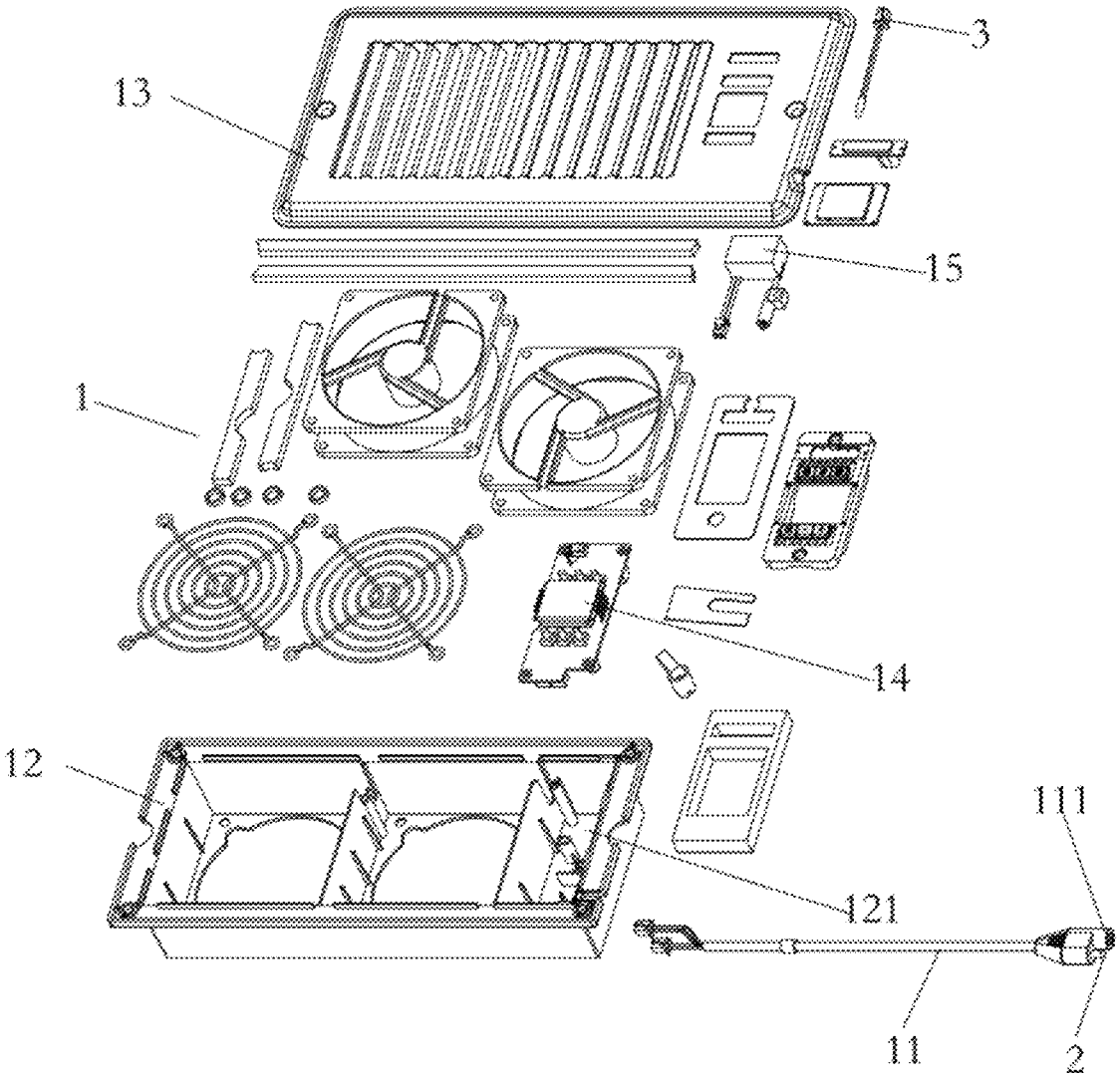
FIG. 1 is an exploded view of an induced draft fan.
Figure 2:
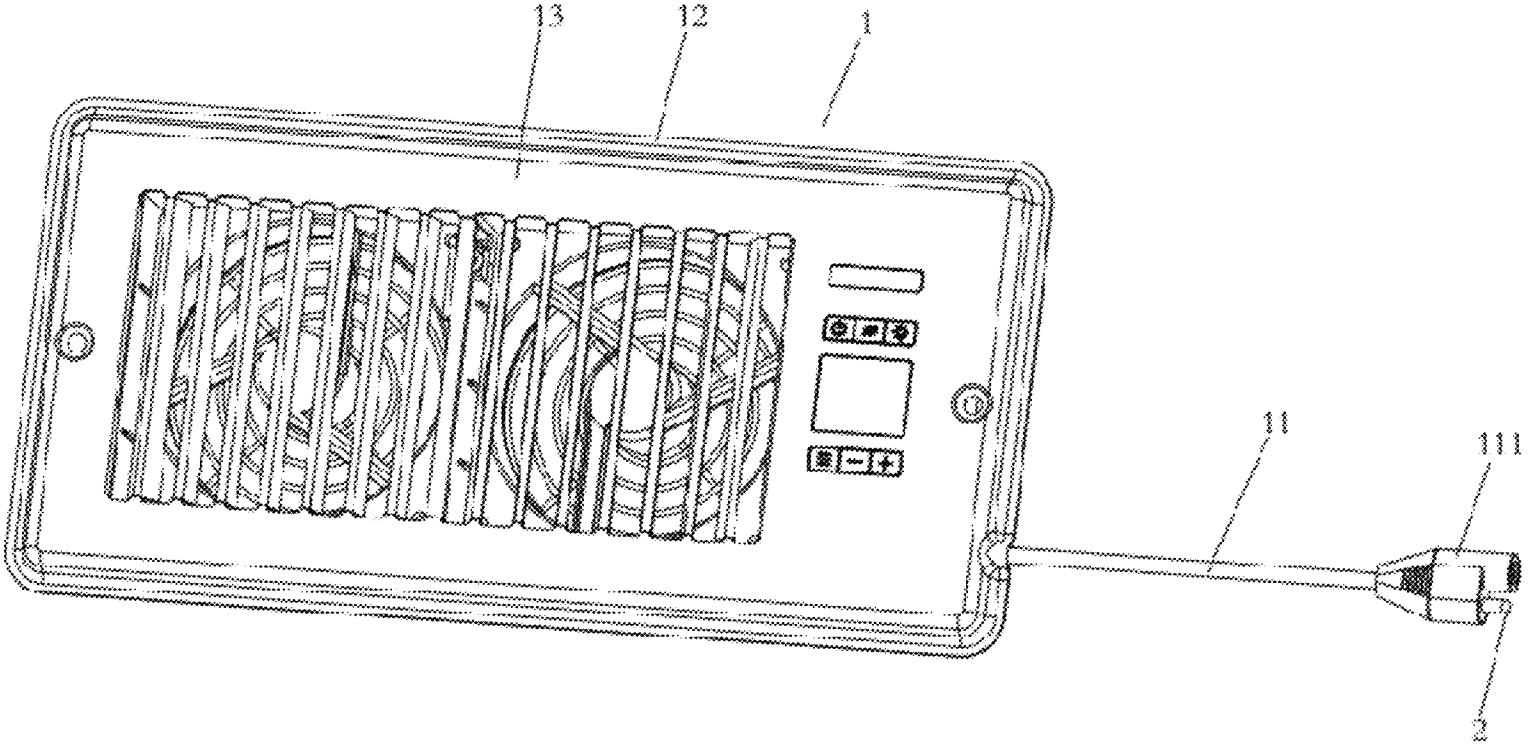
FIG. 2 is an axial side view of an induced draft fan.
Figure 3:
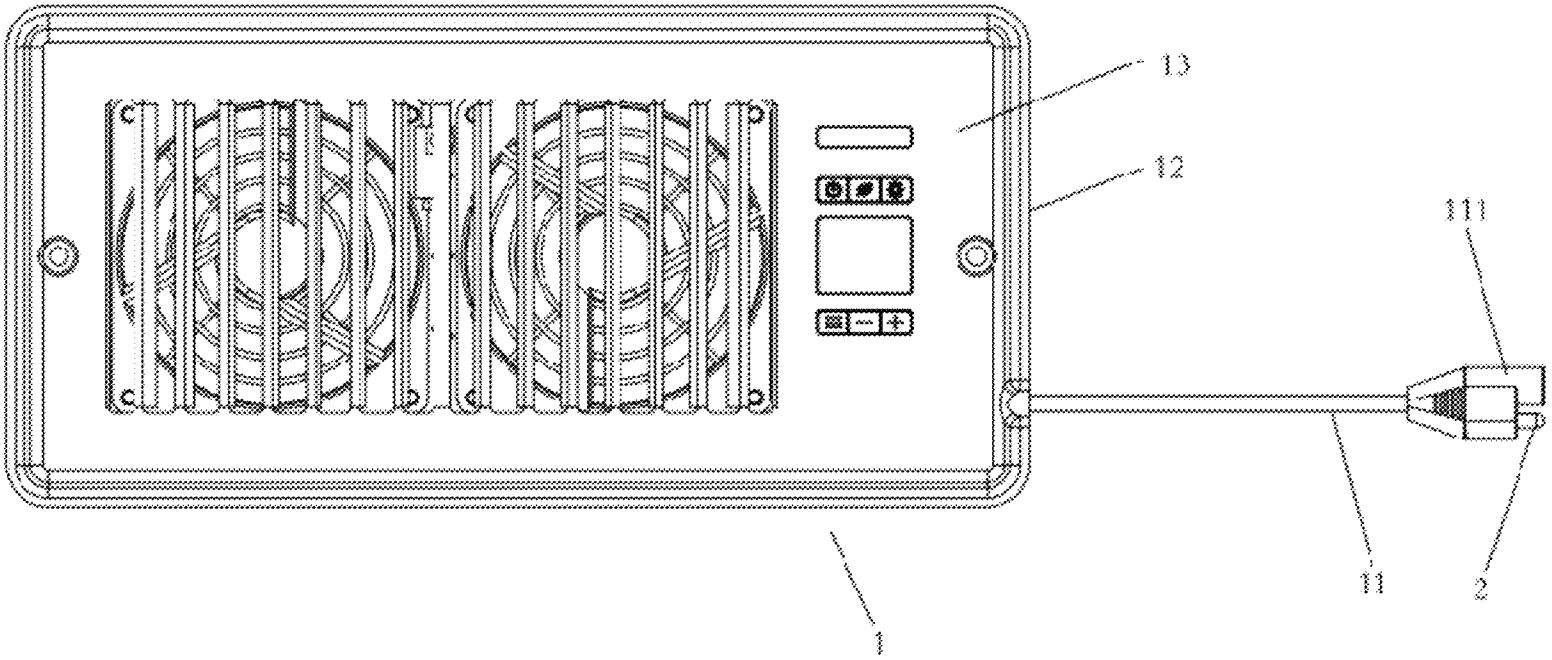
FIG. 3 is a front view of an induced draft fan.
Figure 4:
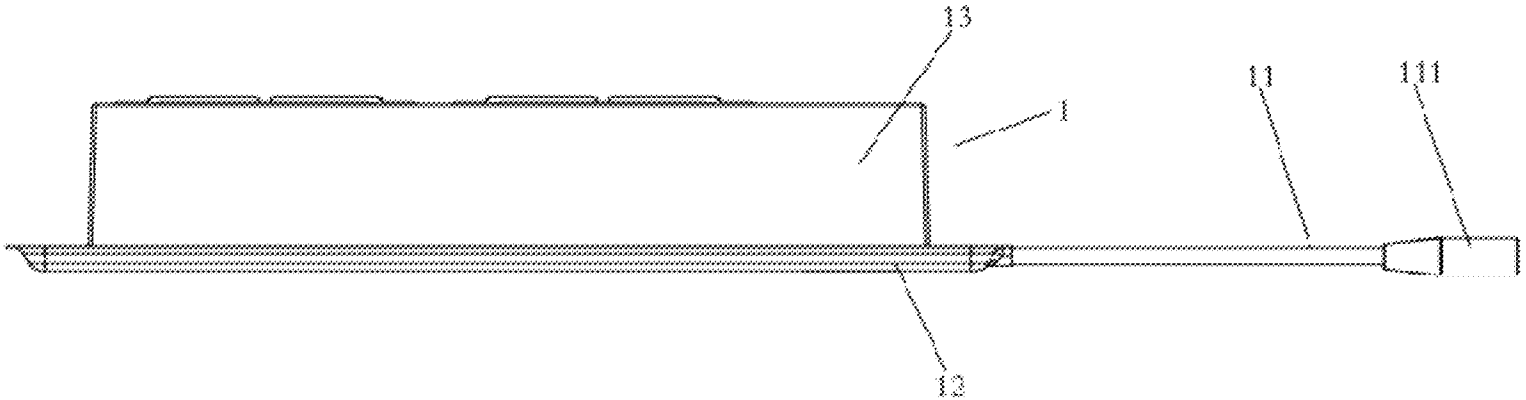
FIG. 4 is a top view of an induced draft fan.
Figure 5:
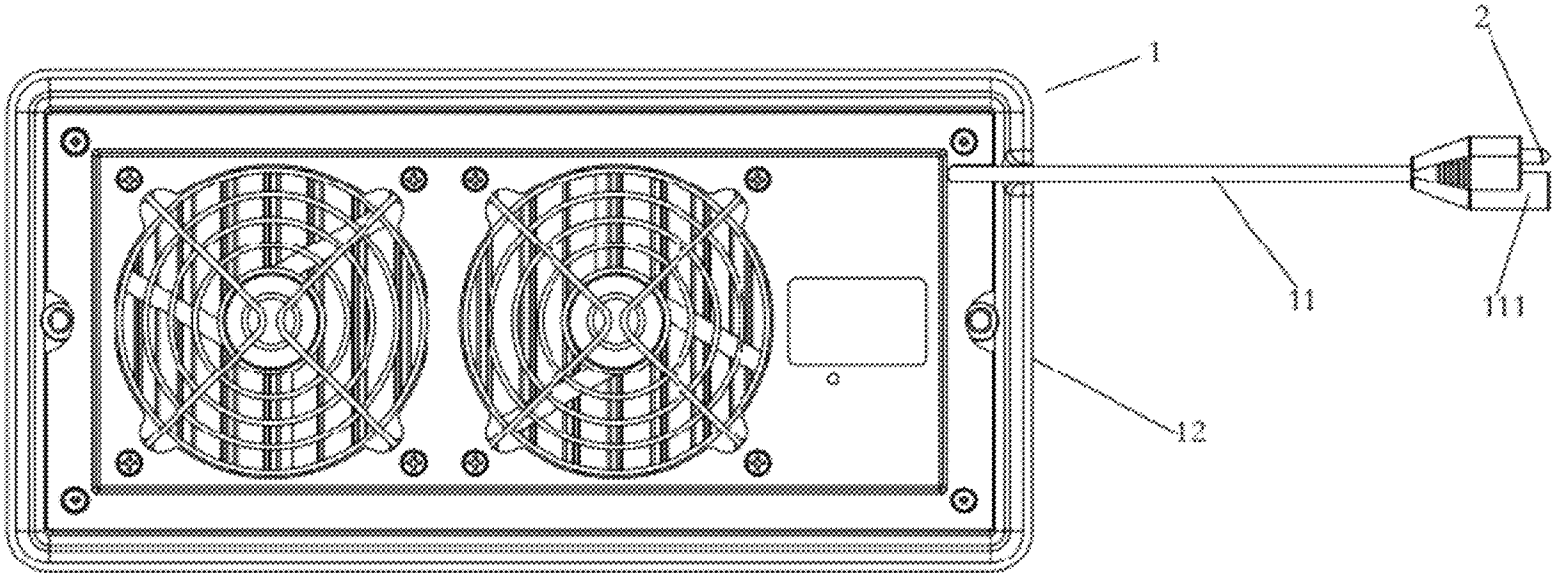
FIG. 5 is a rear view of an induced draft fan.
Figure 6:
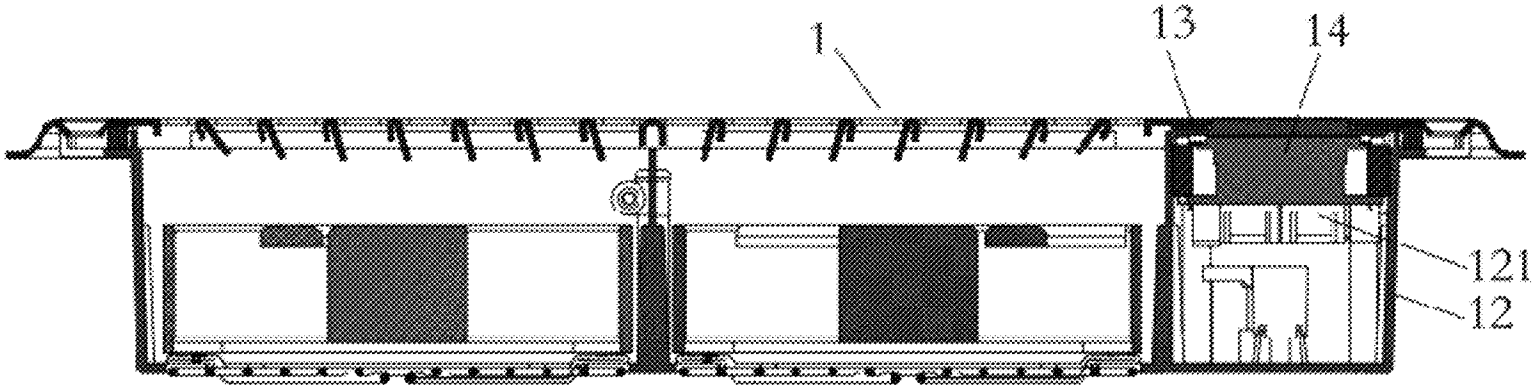
FIG. 6 is a cross-sectional view of an induced draft fan.

The reference numerals in FIGS. 1 to 6 are as follows: fan main body 1, adapter connection line 11, connector 111, rear cover 12, mounting groove 121, panel 13, control circuit board 14, negative ion generator 15, first temperature sensor 2; second temperature sensor 3.

DETAILED DESCRIPTION OF THE EMBODIMENTS

In order to make the technical problems, technical solutions and beneficial effects to be solved in the invention more clear, the following combined with the appended drawings and examples, the invention is further explained in detail. It should be understood that the specific examples described herein are merely used for explanation of the invention and are not intended to be limiting thereof.

Referring to FIGS. 1 to 6, an induced draft fan includes a fan main body 1, a first temperature sensor 2, and a second temperature sensor 3.

The fan main body 1 includes an adapter connection line 11 extending from the same for supplying power to the fan main body 1.

The first temperature sensor 2 is mounted on the adapter connection line 11, electrically connected to a control circuit board 14 inside the fan main body 1 and is capable of detecting an indoor temperature at a location remote from the fan main body 1. In this embodiment, the first temperature sensor 2 is mounted on a connector 111 of the adapter connection line 11 with a sensing probe exposed so as to be as far away from the fan main body 1 as possible. In addition, the wires of the first temperature sensor 2 and the adapter connection line 11 share a same wire protection rubber sleeve to avoid exposing the wires of the first temperature sensor 2. The first temperature sensor 2 and the connector 111 of the adapter connection line 11 share a same encapsulated housing which may be specifically a rubber housing, simplifying the structure of the connector 111 and reducing the subsequent assembly steps. The structure is compact and firm.

The second temperature sensor 3 is disposed inside the fan main body 1 and faces towards an air inlet end of the fan main body 1, and is electrically connected to the control circuit board 14 inside the fan main body 1. It can detect the air temperature inside the fan main body 1 or inside the pipeline.

In an embodiment, the fan main body 1 includes a rear cover 12 and a panel 13. The rear cover 12 is provided with a mounting groove 121 facing towards the panel 13. The control circuit board 14 is mounted in the mounting groove 121. The panel 13 covers the rear cover 12 and presses the control circuit board 14. The control circuit board 14 is provided with a display screen and keys. The panel 13 is provided with avoidance openings corresponding to both the display screen and the keys.

On the basis of the above-mentioned embodiment, in order to improve the indoor air quality, in other embodiments, a negative ion generator 15 is further disposed inside the fan main body 1 and is electrically connected to a control circuit board 14 inside the fan main body 1, so that negative ions can be supplied to the room to purify air. In addition, in order to prevent the negative ion generator from affecting the operation of the control circuit board and its display screen, the negative ion generator is disposed at a position away from the control circuit board.

The fan main body 1 includes two blowers arranged side by side to provide a greater suction force.

In an embodiment, the invention provides an air conditioning system including an air conditioning unit and the induced draft fan of the above-mentioned embodiment.

The invention can acquire a more accurate indoor temperature value by arranging the first temperature sensor 2 on the adapter connection line 11 of the fan main body 1 so as to follow the adapter connection line 11 away from the fan main body 1, and avoid improper start-up or shut-down instructions of the induced draft fan caused by measurement errors of the temperature value.

An illustrative description of the invention is given above in conjunction with the accompanying drawings. It is obvious that the specific implementation of the invention is not limited by the above-mentioned method. As long as the method concept and technical solutions of the invention are adopted for various non-substantive improvement, or the idea and technical solutions of the invention are directly applied to other occasions without improvement, they are within the scope of protection of the invention.

What is claimed is:

1. An induced draft fan, comprising a fan main body, a first temperature sensor and a second temperature sensor;

wherein the fan main body comprises an adapter connection line extending outward from the fan main body, a terminal end of the adapter connection line is provided with a connector, the first temperature sensor is mounted to the connector away from the fan main body, and a sensing probe of the first temperature sensor is exposed, the first temperature sensor is configured to detect ambient indoor temperature remote from the fan main body, and the second temperature sensor is configured to detect air temperature inside the fan main body or inside a pipeline, and an accurate control of the fan main body is realized by comparing a value of the ambient indoor temperature and a value of the air temperature inside the fan main body or inside the pipeline;

the first temperature sensor is electrically connected to a control circuit board inside the fan main body; and the second temperature sensor is disposed inside the fan main body and faces towards an air inlet end of the fan main body, and is electrically connected to the control circuit board inside the fan main body.

2. The induced draft fan according to claim 1, wherein the wires of the first temperature sensor and the adapter connection line share a same wire protection rubber sleeve.

3. The induced draft fan according to claim 2, wherein the first temperature sensor and the connector of the adapter connection line share a same encapsulated housing.

4. The induced draft fan according to claim 1, wherein a negative ion generator is further disposed inside the fan main body and electrically connected to the control circuit board inside the fan main body.

5. The induced draft fan according to claim 4, wherein the negative ion generator is located remotely from the control circuit board.

6. The induced draft fan according to claim 1, wherein the fan main body comprises a rear cover and a panel; the rear cover is provided with a mounting groove facing towards the panel; the control circuit board is mounted in the mounting groove; the panel covers the rear cover and presses the control circuit board; and the control circuit board is provided with a display screen and keys; and the panel is provided with avoidance openings corresponding to both the display screen and the keys.

7. The induced draft fan according to claim 1, wherein the fan main body comprises two blowers arranged side by side.

8. An air conditioning system, comprising an air conditioning unit and the induced draft fan according to claim 1.

* * * * *